US005478169A

United States Patent [19]

Stegall

[11] Patent Number: 5,478,169

[45] Date of Patent: Dec. 26, 1995

[54] METHOD AND APPARATUS FOR FORMING A TRENCH

[76] Inventor: Lannie L. Stegall, 4505 Paynes Mill Rd., Versailles, Ky. 40383

[21] Appl. No.: 121,042

[22] Filed: Sep. 13, 1993

[51] Int. Cl.[6] ..... E02B 5/00

[52] U.S. Cl. ..... 405/119; 249/11; 404/2; 404/4; 405/118

[58] Field of Search ..... 405/118–121; 404/2–4; 210/163, 164; 249/9, 11

[56] References Cited

U.S. PATENT DOCUMENTS

| | | |
|---|---|---|
| 786,305 | 4/1905 | McIntyre . |
| 1,473,551 | 11/1923 | Gschwind . |
| 1,562,780 | 11/1925 | Mickelson . |
| 1,631,825 | 8/1929 | Alder . |
| 1,699,948 | 1/1929 | Biedermann . |
| 1,722,038 | 7/1929 | Dougherty . |
| 2,170,671 | 8/1939 | Alder . |
| 2,657,447 | 11/1953 | Pellanda, Jr. . |
| 2,677,165 | 5/1954 | Copenhaver et al. . |
| 2,917,804 | 12/1959 | Barron . |
| 2,938,437 | 5/1960 | Daley . |
| 3,212,267 | 10/1965 | Biehn . |
| 3,299,785 | 1/1967 | James . |
| 3,362,167 | 1/1968 | Ward . |
| 3,568,455 | 3/1971 | McLaughlin et al. . |
| 3,625,011 | 12/1971 | Stevenson . |
| 3,797,188 | 3/1974 | Mansfeld . |
| 4,142,371 | 3/1979 | Mayfield . |
| 4,258,897 | 3/1981 | Stees . |
| 4,472,078 | 9/1984 | Karbstein . |
| 4,498,807 | 2/1985 | Kirkpatrick et al. . |
| 4,787,773 | 11/1988 | Kehler . |
| 4,844,655 | 7/1989 | Aleshire . |
| 4,878,782 | 11/1989 | Beattie et al. . |
| 4,957,268 | 9/1990 | Picollo et al. . |
| 4,993,877 | 2/1991 | Beamer . |
| 4,993,878 | 2/1991 | Beamer . |
| 5,000,621 | 3/1991 | Beamer . |
| 5,061,116 | 10/1991 | Monks . |
| 5,066,165 | 11/1991 | Wofford et al. . |

FOREIGN PATENT DOCUMENTS

| | | |
|---|---|---|
| 968267 | 10/1982 | U.S.S.R. . |
| WO90/11405 | 10/1990 | WIPO . |

OTHER PUBLICATIONS

EconoDrain™ by MultiDrain Brochure (1992).

EconoDrain™ by MultiDrain (02725/MUN—BuyLine 7497).

*Primary Examiner*—Dennis L. Taylor

[57] ABSTRACT

A trench forming assembly and removable form for forming a trench of predetermined shape is disclosed according to the present invention. The removable form includes an elongate form body having top, bottom and opposed side surfaces and first and second elongate form removal slots extending upwardly from the bottom surface of the form body. Preferably the removable form has a top surface defining a complex shape including at least a first upwardly extending ear portion which extends longitudinally along the top surface. At least a first form removal slot of this elongate form body extends into a portion of the first ear portion. Advantageously, the form body includes a pair of coplanar elongate slots integrally formed in the side surfaces for receiving a pair of frame members in a predetermined coplanar, spaced relationship above the bottom surface of the form body. In another embodiment, a removable form includes a second elongate form body portion extending laterally along one side surface of the elongate form body and having a predetermined shape for forming a structure having a corresponding shape, such as a curb.

53 Claims, 5 Drawing Sheets

METHOD AND APPARATUS FOR FORMING A TRENCH

FIELD OF THE INVENTION

The invention relates to methods and apparatus for forming trenches. More particularly, the invention relates to methods and apparatus for forming a trench with a removable form body.

BACKGROUND OF THE INVENTION

Drainage and other trenches of various sizes and shapes are desirable for numerous applications. For example, manufacturing facilities typically require drainage systems which include trenches formed in the building floors to collect, remove and/or recycle excess water or other liquids. In addition, numerous outdoor industrial and commercial sites, such as parking lots, require drainage systems, including trenches, to collect and direct rainwater and other liquids to underground storm sewers to prevent flooding and to decrease runoff.

In the past, these trenches have generally been formed by first placing and securing a form of predetermined shape in a ditch which has previously been formed in the ground. A moldable trench forming composition, such as cement, concrete, or the like is then poured around the form and is allowed to set. Once the concrete has set, the form is removed from the resulting trench.

One common type of form assembly used to define a trench includes a wooden frame and strut structure. The wooden form includes a wooden frame which is covered with wooden sheets or planks to define a generally rectangular elongate trough. The wooden form is typically enclosed along its side and bottom faces, but may have an open top. Typically, a number of supporting wooden ribs are installed within the wooden form to increase the strength of the form so that it can withstand the relatively large pressures exerted by moldable trench forming compositions poured about it.

The wooden form is placed and secured within a preformed ditch. Concrete is typically poured up to the bottom face of the form and allowed to set. Then additional concrete is poured between the earthen walls of the ditch and the wooden sides of the form. Once all of the concrete has set, the wooden form is disassembled and removed from the trench.

Wooden forms are generally formed of lumber having a relatively rough exterior texture. Correspondingly, the inside surface of the trench formed by the wooden form is relatively uneven which reduces the efficiency of the flow of liquid through the trench. In addition, the assembly and disassembly of the wooden forms is both costly and labor intensive. The relatively large cost and labor required for assembly and disassembly of the wooden forms is increased in the formation of long trenches, and even further increased in the formation of trenches having a pitched or slanted bottom surface to facilitate drainage.

It is normally desirable to finish the trench with an elongate grate covering its open top in order to prevent people from unwittingly stepping in the open trench, to provide a smooth surface for vehicle travel, and/or to prevent relatively large objects from entering the trench and potentially blocking the flow of liquid therethrough. The grate is generally supported by a pair of spaced apart frame members which are set into and extend from the walls of the concrete trench. In order to stabilize the grate and to prevent the grate from rocking when weight, such as from a passing vehicle, is applied thereto, the frame members must be aligned in a common plane during the pouring and setting of the concrete about the form. If the grate is not properly aligned, the grate, the frame members and/or the concrete trench itself may be damaged by the resulting movement of the grate. If the grate rocks excessively, the grate may even be dislodged from the frame members thus leaving the trench exposed. Accordingly, the alignment of the frame members in the moldable trench forming composition is both important and laborious.

In an attempt to properly align the frame members without laborious manual alignment, precast trench assemblies have been developed. Precast trench assemblies generally include preformed metal and/or plastic assemblies designed to be placed in a preformed ditch. Moldable trench forming composition may thereafter be poured about the precast trench assembly. Once the trench forming composition has set, the precast trench assembly is securely bonded to the trench forming composition to stabilize and support the trench. Precast trench assemblies, however, are relatively expensive and may only be used once.

Commercially significant methods and apparatus for forming trenches, together with improved removable forms for forming trenches, are disclosed in U.S. patent application Ser. No. 07/768,610 to Stegell filed Sep. 26, 1991. In advantageous embodiments thereof inexpensive forms are employed to form trenches having properly aligned frame members.

The trench forming assembly disclosed in U.S. patent application Ser. No. 07/768,610 preferably includes longitudinal frame members having a plurality of anchoring rods extending downwardly from the frame members. An elongate form body, preferably formed of relatively lightweight expanded polystyrene, generally includes aligned longitudinal slots in the opposed side walls for receiving the frame members. Horizontal portions of the frame members are secured within the longitudinal slots in the sidewalls of the form body during formation of the trench so that the frame members are held in alignment during the trench forming operation.

Preferably the assembled form and frame members are placed into a prepared ditch by suspending the assembly from its top. Concrete is first poured around the bottom of the anchoring legs attached to the frame members and allowed to set. Then concrete is poured around the form body and allowed to set. Finally the form body is removed to expose the resulting trench and the properly aligned frame members. The removal of the form is preferably facilitated by a pair of slots extending a relatively short distance into the form body from its bottom surface. Wires are provided in the slots and, once the trench forming composition has set, are pulled upwardly through the form. The form body is thereby cut into several pieces that can be more easily removed from the trench.

SUMMARY OF THE INVENTION

The present invention provides improved trench forming methods and apparatus. In one aspect the invention provides form bodies which can be readily removed from the trench upon setting of the moldable trench forming composition without requiring the use of wires for cutting the form into pieces prior to its removal. In other aspects, this invention provides a trench forming assembly which allows the removable form to be readily aligned and suspended within a preformed ditch. The invention also provides form bodies for simultaneously forming structures, such as curbs, adjacent to the trench.

In a first aspect, the invention provides improved forms for forming trenches of predetermined shapes which can be readily and efficiently removed following the trench forming operation. In accordance with this aspect, an elongate form body having a bottom surface and opposed side surfaces for defining the shape of the trench, includes means formed along the opposed side surfaces of the form body for engaging a pair of frame members defining a support surface for supporting a trench cover. The form body also includes first and second form removal slots which extend within the form body longitudinally from end to end and upwardly from the bottom surface thereof to a location below the top surface of the form and above the location of the frame members engaged by its side surfaces. Following use of the form body to form a trench, a portion of the top of the form body can readily be removed, as by a cutting operation or the like to expose the top of the form removal slots and thereby separate the form body into pieces which can easily be removed from the newly formed trench.

In another advantageous embodiment, a removable form body of the invention includes an upper surface having a complex cross-sectional shape including at least one upwardly extending ear which extends above at least one lower portion of the top surface and which also extends longitudinally along the top surface. At least one form removal slot within the form body extends upwardly into a portion of the ear so that the top of the form removal slot can be exposed by cutting or removing the ear portion of the form body, as by cutting or scraping along the top of the form body.

In another embodiment of the invention, the top surface of the form body also includes a second upwardly extending ear which also extends upwardly above the lower portion of the top surface and longitudinally along the length of the form body. The two upwardly and longitudinally extending ears are advantageously spaced laterally from each other to define a central recess extending longitudinally along the top of the form body. Advantageously, the central recess is substantially rectangular in cross-section and is of a predetermined size for receiving an alignment member of like cross-section. One preferred alignment member can be framing lumber of a conventional cross-section of about 2 in. by about 4 in. An alignment member which has been properly aligned and anchored in a suspended position over a prepared ditch can be secured into the central recess of the form to readily support and align the form in the ditch.

In embodiments of the invention wherein the top surface of the form body includes two upwardly extending ears, each of the form removal slots preferably extend upwardly into a portion of one of the ears. Advantageously, each of the form removal slots extends upwardly at least ¼ inch into each of the ears.

The first and second form removal slots preferably define, in transverse cross-section, a truncated V-shaped wedge portion of the form body. The V-shaped wedge portion of the form body is integrally joined to other portions of the form body by a portion of the top of the form body. The upwardly extending form removal slots diverge such that the lateral spacing therebetween increases in an upward direction from the bottom surface of the form body toward the top surface. i.e. the truncated V-shaped portion of the form body is oriented in an upright position. The lateral spacing between the first and second form removal slots at the bottom surface of the form body is preferably less than about 1.5 inch so that only minimal fluid pressure is applied to the bottom of the wedge by concrete or other unset trench forming material. Advantageously, the diverging first and second form removal slots define an angle of between about 5° and 45°.

In various preferred embodiments of the invention, the means for securing the frame members to the sides of the form body comprise a pair of coplanar elongate slots integrally formed in the side surfaces of the form body. Preferably at least one of the form removal slots extends upwardly above the elongate slots by at least about ¼ inch.

In yet another embodiment of the present invention, the removable form body also includes a second elongate body portion that extends and laterally outwardly along at least one side surface of the elongate form body and which has a predetermined external shape for forming a surface having a corresponding shape adjacent the trench. The second elongate body portion is preferably integrally joined by a portion of form material to the top surface of the elongate form body. Advantageously, the external shape of the second portion of the form body defines a curb of a corresponding predetermined shape adjacent to and aligned with the trench.

The form bodies and trench forming assemblies of the present invention simplify the trench forming operation because the forms can readily be removed from a finished trench without requiring cutting wires to be supplied in the form. In preferred embodiments, the alignment recess along the top of the form simplifies the process of aligning a trench forming assembly within a preformed ditch or other location. Moreover the invention also allows for the simultaneous formation of other structures such as curbs or the like, adjacent the trench.

BRIEF DESCRIPTION OF THE DRAWINGS

In the drawings which form a portion of the original disclosure of the invention.

DETAILED DESCRIPTION OF A PREFERRED EMBODIMENT

Figure 1:
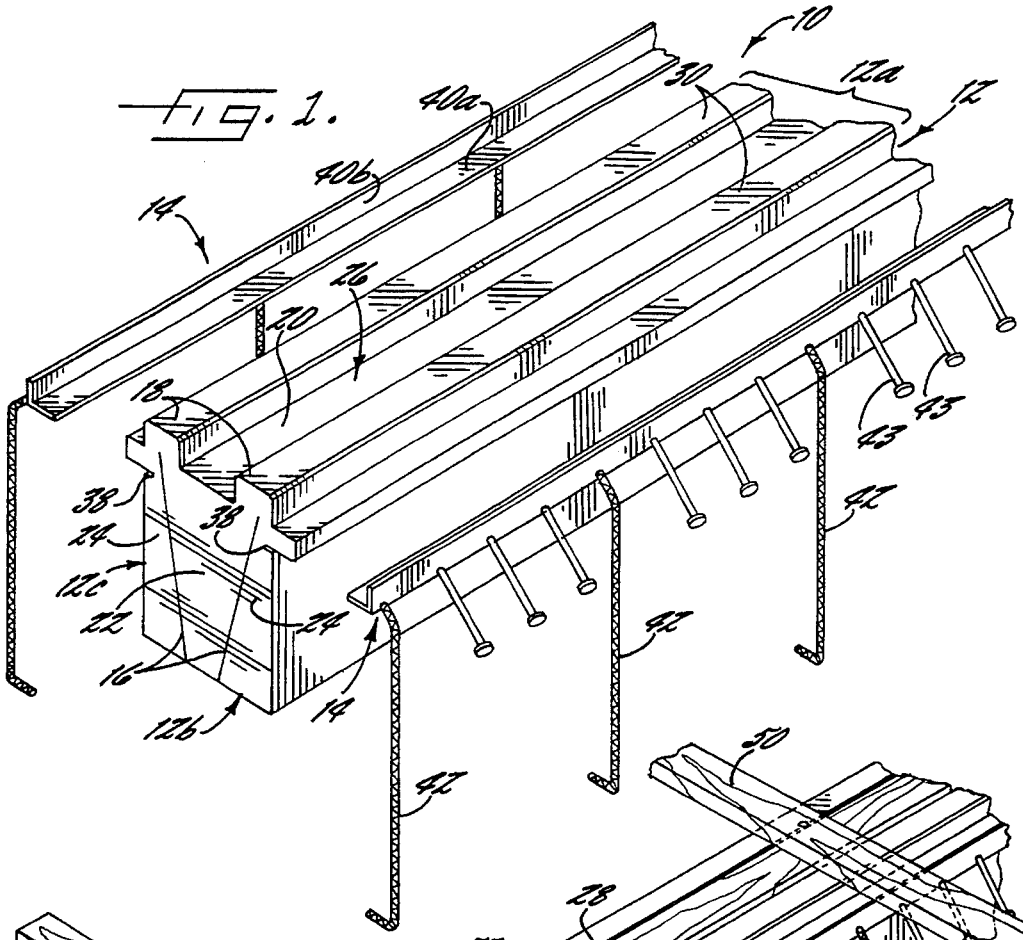
FIG. 1 is an exploded perspective view of one preferred trench forming assembly according to the present invention.

Various methods and apparatus embodiments of the invention are set forth below. While the invention is described with reference to specific preferred methods and apparatus including those illustrated in the drawings, it will be understood that the invention is not intended to be so limited. To the contrary, the invention includes numerous alternatives, modifications and equivalents as will become apparent from consideration of the foregoing discussion and the following detailed description.

FIG. 1 illustrates an assembly 10 for forming a trench of a predetermined shape. The trench forming assembly 10 includes an elongate form body 12 and a pair of frame members 14. The elongate form body 12 includes a top surface 12*a*, a bottom surface 12*b*, and opposed side surfaces 12*c* for forming a moldable trench forming composition into a trench of predetermined shape. The removable form also includes first and second form removal slots 16 extending upwardly into the form body from the bottom surface 12*b* thereof.

As illustrated in the drawings, the top surface 12*a* of the form body defines in transverse cross-section, a complex shape, including at least a first upwardly extending ear portion 18. The first ear portion 18 extends upwardly above at least one lower portion 20 of the top surface 12*a* and longitudinally along the top surface 12*a*. One of the form removal slots 16 extends into a lower portion of the first ear 18.

As seen in FIG. 1 the top surface 12*a* of the form body 12 further includes a second upwardly extending ear 18 that also extends upwardly above a lower portion 20 of the top surface 12*a* of the form body and longitudinally along the top surface 12*a*. The second form removal slot 16 extends upwardly into a lower portion of the second ear 18. Preferably, each of the first and second form removal slots extends at least about ¼ inch upwardly into the lower portion of one of the ears 18.

As illustrated in FIG. 1, the first and second form removal slots 16 define, in transverse cross-section, an interiorly located truncated V-shaped wedge portion 22 of the form body. The truncated V-shaped wedge portion 22 is integrally joined to corresponding lateral portions 24 of the form body 12 only by portions of the form body adjacent its top surface 12*a* and which also join the ears to the main portion of the from body.

Figure 3:
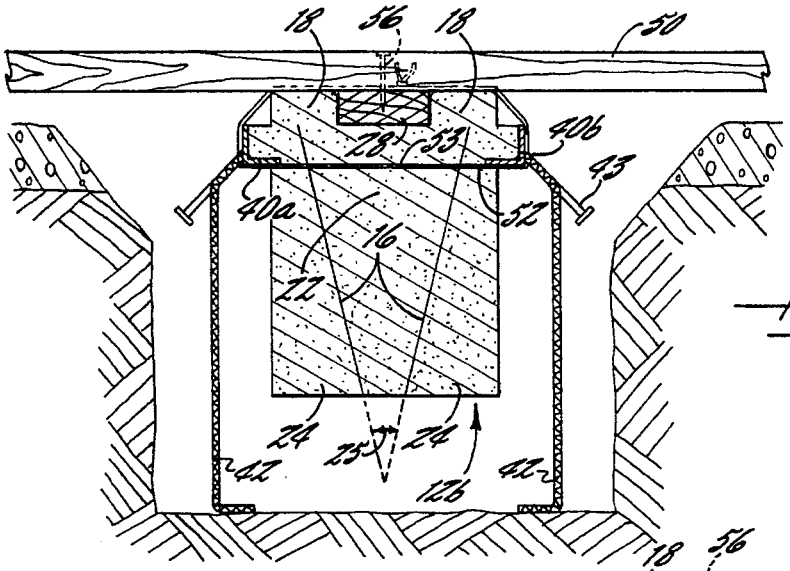
FIG. 3 is a cross-sectional view of the trench forming assembly of FIG. 2 following placement thereof in a preformed ditch.

The first and second form removal slots 16 extend longitudinally from end to end of the form body. The slots 16 extend upwardly into the form body in a divergent arrangement. Preferably the slots diverge in a vertical or upward direction such that the lateral spacing between corresponding horizontal portions thereof increases from the bottom surface 12*b* of the form body towards the top surface 12*a*. Preferably, the first and second form removal slots 16 define an interior angle 25 (FIG. 3) of between about 5° and about 45°.

Advantageously, a relatively small lateral spacing is provided between the first and second form removal slots 16 at the bottom surface 12*b* of the form body. Preferably, the lateral spacing between the first and second form removal slots 16 at the bottom surface 12*b* of the form body is less than about 1.5 inch. The limited lateral spacing between the first and second form removal slots 16 at the bottom surface 12*b* of the form body decreases the magnitude of the upward hydraulic forces imparted by the fluid trench forming composition on bottom of the V-shaped wedge portion 22 as discussed more fully below.

Figure 2:
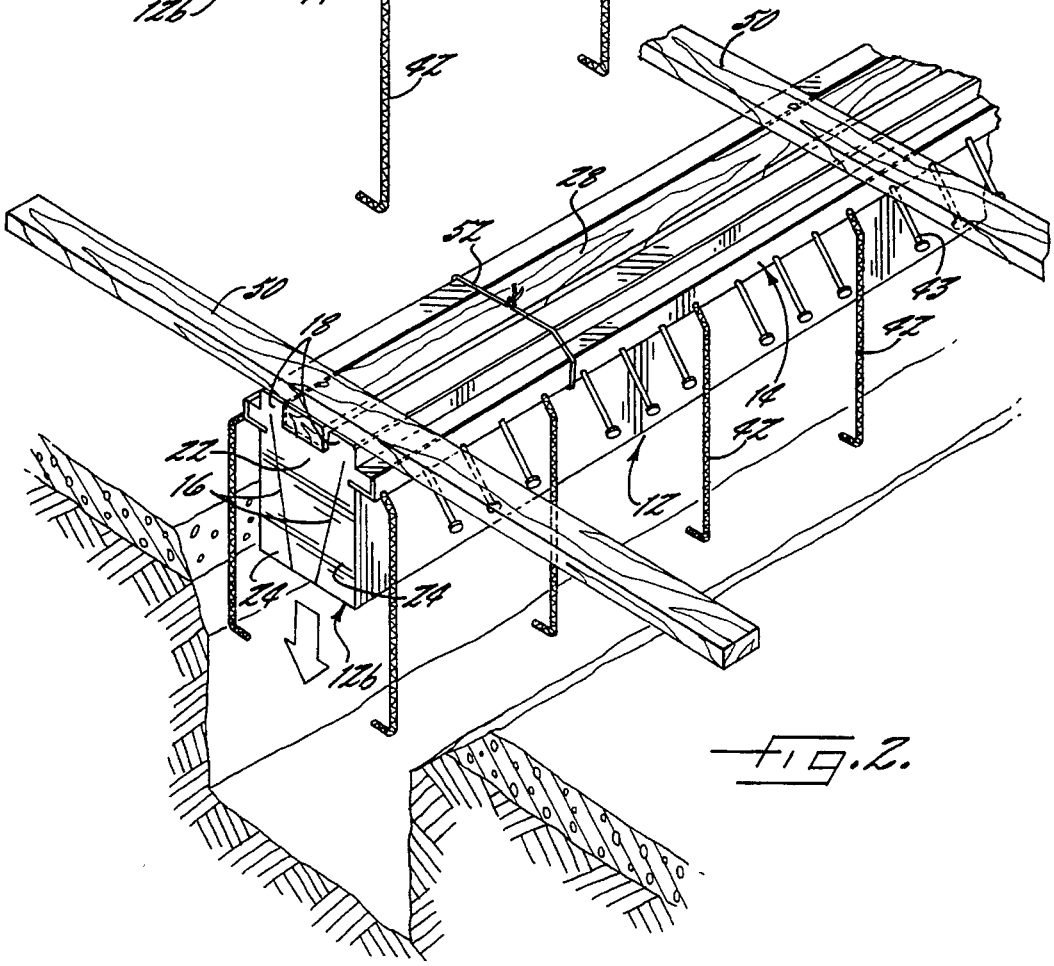
FIG. 2 is a perspective view of the trench forming assembly of FIG. 1 and illustrates attachment of the removable form to an alignment member, which in turn is attached to batter boards, to facilitate placement and alignment of the assembly in a preformed ditch.

As illustrated in FIG. 1, the inside edges of the first and second ears 18 and a lower portion 20 of the top surface 12*a* between the first and second ears 18 cooperate to define a central recess 12*a* of substantially rectangular cross-section of predetermined size. The central recess 26 extends longitudinally along the top surface 12*a* of the form body and is sized to receive an alignment member 28 of like cross-section as illustrated in FIG. 2. Preferably, the upper surface 30 of each of the first and second ears 18 is spaced a predetermined distance, preferably at least about two inches above the lower portion 20 of the top surface 12*a* to receive the alignment member 28, such as a piece of framing lumber measuring about 2 in.×4 in. in transverse cross-section.

Advantageously, the removable elongate form body 12 includes means formed along the opposed side surfaces 12*c* for engaging the frame members 14 with the removable form. The engaging means are preferably provided in the form of a pair of horizontal coplanar slots 38 spaced above the bottom surface 12*b* of the form body. Such engagement slots 38 are discussed in detail in the aforementioned U.S. patent application Ser. No. 07/768,610 to Stegall. The entire disclosure of U.S. patent application Ser. No. 07/768,610 is hereby incorporated by reference. Various details disclosed in the incorporated patent application are not repeated herein for the sake of brevity. However, reference may be had to the incorporated patent application for such details.

As illustrated in the drawings the form removal slots 16 extend from the bottom surface 12*b* of the form body upwardly above the top of the frame members 14. Preferably, each of the form removal slots 16 extends upwardly above the top of the frame members 14 for a distance of at least about ¼ inch.

The frame member engagement slots 38 defined in the opposed side surfaces 12*c* of the form body are advantageously coplanar for receiving and maintaining the frame members in a predetermined coplanar, spaced relationship above the bottom surface 12*b* of the form body. The first and second frame member engagement slots 38 advantageously extend approximately ⅜ inch into the first and second side walls, respectively. As illustrated in FIG. 1, the removable elongate form body 12 preferably includes a top surface 12*a* including at least a first ear portion 18 and also side surfaces having engaging means for engaging a pair of frame members.

The frame members 14 define a surface for supporting a trench cover 48 and typically serve directly as a support surface for the trench cover 48. Alternatively, the frame members can function as shaping elements for shaping the hardenable trench forming composition into a pair of recesses for receiving a trench cover 48, in which case the frame members 14 are removed to expose the trench cover receiving recesses following hardening of the trench forming composition. Further discussion of such removable frames members is provided in considerable detail in U.S. patent application Ser. No. 07/768,610 filed concurrently herewith entitled "TRENCH FORMING ASSEMBLIES HAVING ENHANCED ANCHORING MEANS" which is hereby incorporated by reference.

As illustrated in FIG. 1, each of the frame members 14 preferably includes a horizontal elongated portion 40*a* adapted for insertion in the first and second longitudinal form alignment slots 38, respectively.

The frame members 14 also preferably include a plurality of anchoring legs 42, typically formed of rebar, extending downwardly therefrom. As subsequently discussed, the plurality of legs 42 are adapted to anchor the form body in a subslab 46 of moldable trench forming composition poured around the lower portion 20 of each of the legs 42 and below the bottom surface 12*b* of the form body.

Figure 7:
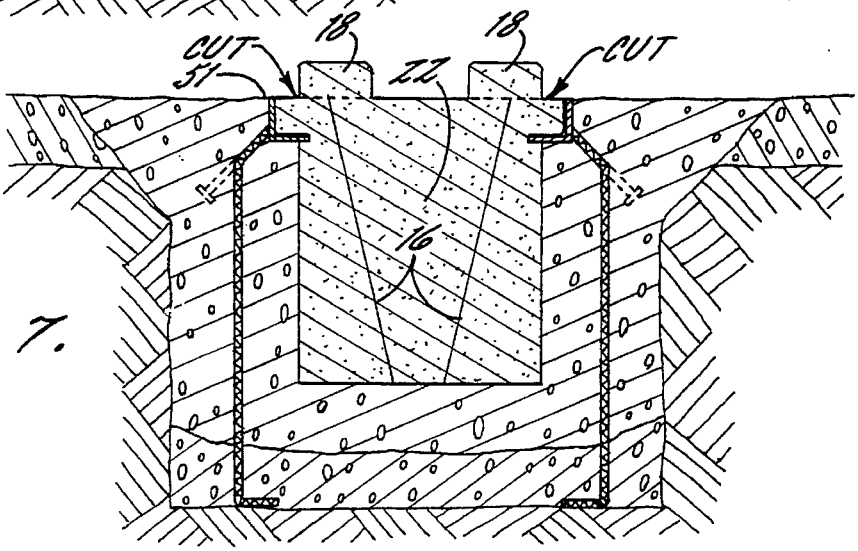
FIG. 7 is a cross-sectional view of the trench forming assembly wherein the removable form body is surrounded by moldable trench forming composition and indicates one preferred location for severing of upper ears on the removable form body to allow removal the form body.
Figure 8:
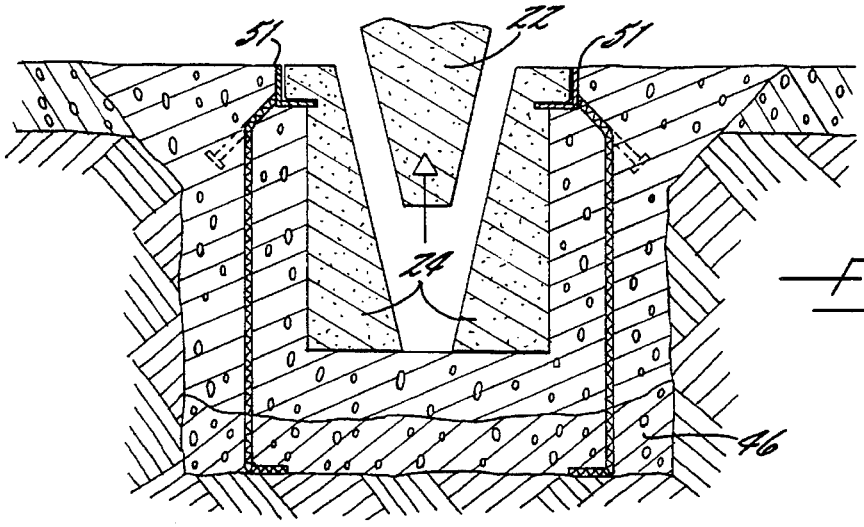
FIG. 8 is a cross-sectional view of the trench forming assembly illustrating removal of the truncated V-shaped wedge portion of the removable form body.
Figure 9:
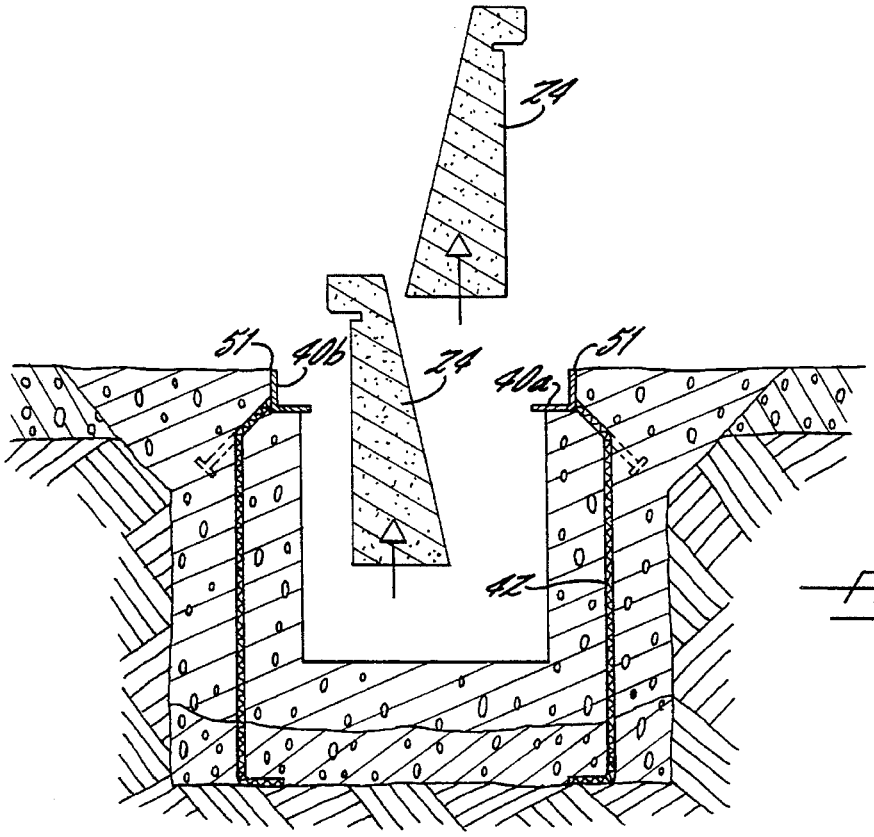
FIG. 9 is a cross-sectional view of the trench forming assembly illustrating removal of the corresponding lateral portions of the removable form body following removal of the truncated V-shaped wedge portion.

As illustrated, the frame members 14 also preferably includes a plurality of additional anchors 43 extending outwardly and downwardly from both the first and second frame members 14. These anchors 43 are adapted to extend into and be engaged by the hardenable trench forming composition poured about the removable form as illustrated in FIGS. 7–9. These anchors 43 further facilitate the retention of the frame members 14 within the trench formed of hardenable trench forming composition.

A preferred embodiment of the elongate frame members 14 is illustrated in FIG. 1. In this embodiment each frame member includes an elongate horizontally oriented leg 40*a* and an elongate vertically oriented leg 40*h* affixed, along a first edge, to the horizontal leg 40*a*. The elongate horizontal leg 40*a* is adapted for insertion in a longitudinal form alignment slot 38. The elongate horizontal leg 40*a* also is adapted to define a support surface for supporting the trench cover 48 placed over the resulting trench. The elongate vertical portion 40*b* contacts the form body 12 upwardly along a side surface 12*c* thereof following engagement of the frame member into the slot 38.

Figure 12:
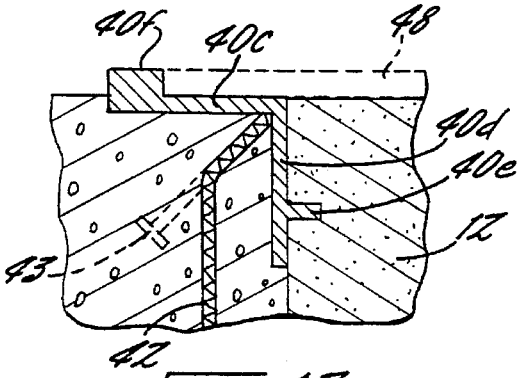
FIGS. 12 and 13 illustrate alternative frame members that can be used in the invention.
Figure 13:
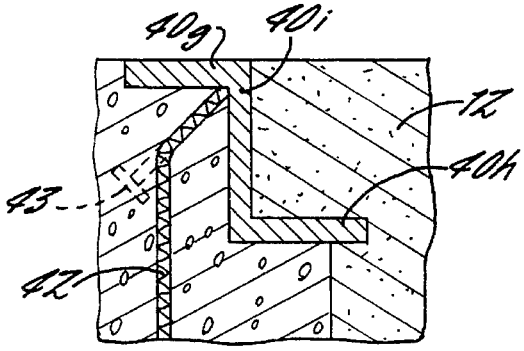

Alternate embodiments of the elongate frame members 14 are illustrated in FIGS. 12 and 13. In FIG. 12, the first and second frame members 14 are comprised of an elongate upper horizontal leg 40*c* and an elongate vertical leg 40*d* extending downwardly from the elongate upper leg 40*c* and also include an inwardly extending removable tab or tang 40*e*. The elongate upper leg 40*c* is adapted for supporting the trench cover 48 placed over the resulting trench. As illustrated, the elongate vertical leg 40*d* extends along a side surface 12*c* of the form body when the frame member is engaged by the form body.

The inwardly extending removable tab or tang 40*e* is shown in engagement within a longitudinal slot 38 defined in a side surface 12*c* of the form body. Upon removal of the form body following formation of the trench, the tab 40*e* may also be detached, thus leaving a relatively planer side leg. It will also be seen that the first and second elongate rails 14 of FIG. 12 also preferably include a raised edge portion 40*f*. The raised edge portion 40*f* extends longitudinally along an outer edge of each horizontal elongate upper leg 40*c* and functions to align and stabilize a trench cover 48.

Figure 10:
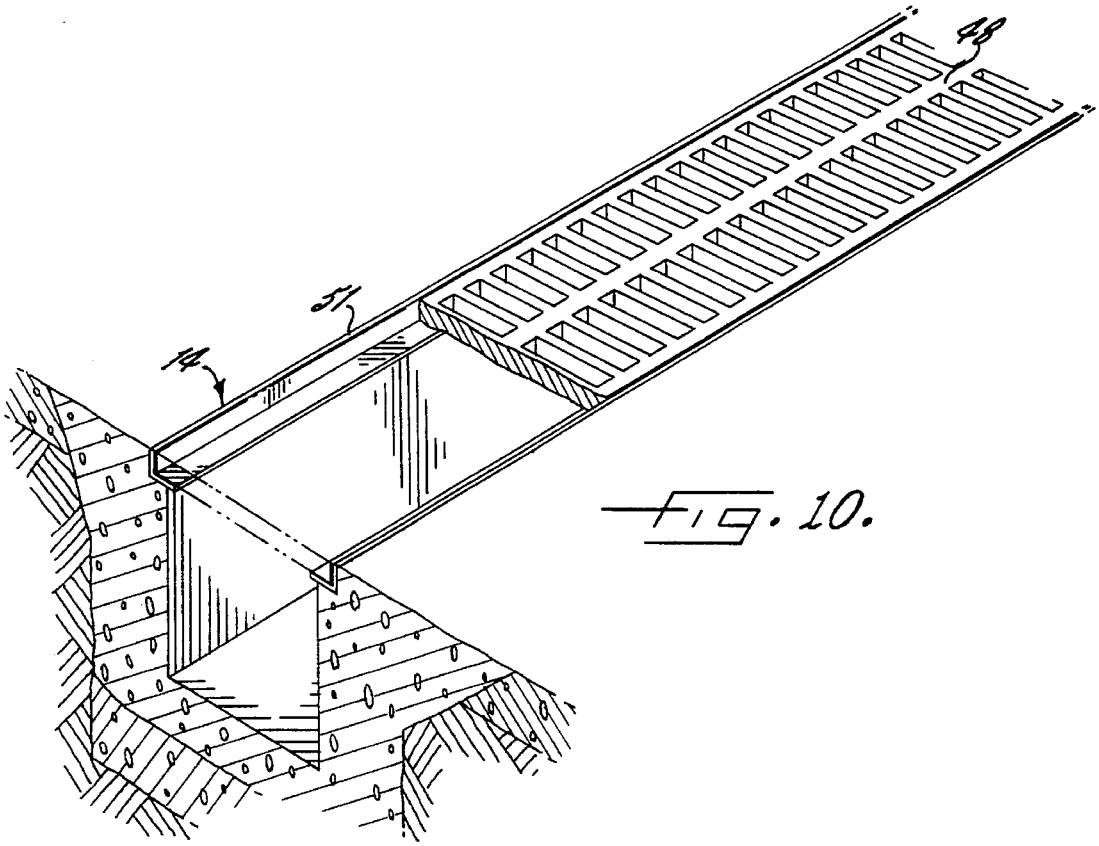
FIG. 10 is a perspective view of the trench forming assembly following removal of the form body and partial installation of a trench cover.

In yet another embodiment illustrated in FIG. 13, the first and second elongate rails 14 each include horizontal elongate upper 40*g* and lower legs 40*h* interconnected by an elongate vertical leg 40*i*. The elongate vertical leg 40*i* extends along a side surface 12*c* of the form body and interconnects the upper 40*g* and lower legs 40*h* such that the upper and lower legs extend outwardly in opposite directions from the vertical leg portion 40*i*. As illustrated, the lower leg 40*h* is adapted for insertion in a longitudinal slot 13*e* defined in a side surface 12*c* of the form body. Other frame members not specifically shown can also be used in the invention, such as for example a frame member like that shown in FIG. 1 but having a series of removable tangs spot welded or filet welded onto the front edge of the horizontal leg 14*a* of the frame member. This allows the tangs to be inserted into the slot in the form and broken off following formation of the trench, with the result that the overhanging portion of the frame member shown in FIG. 10 is eliminated.

Figure 11:
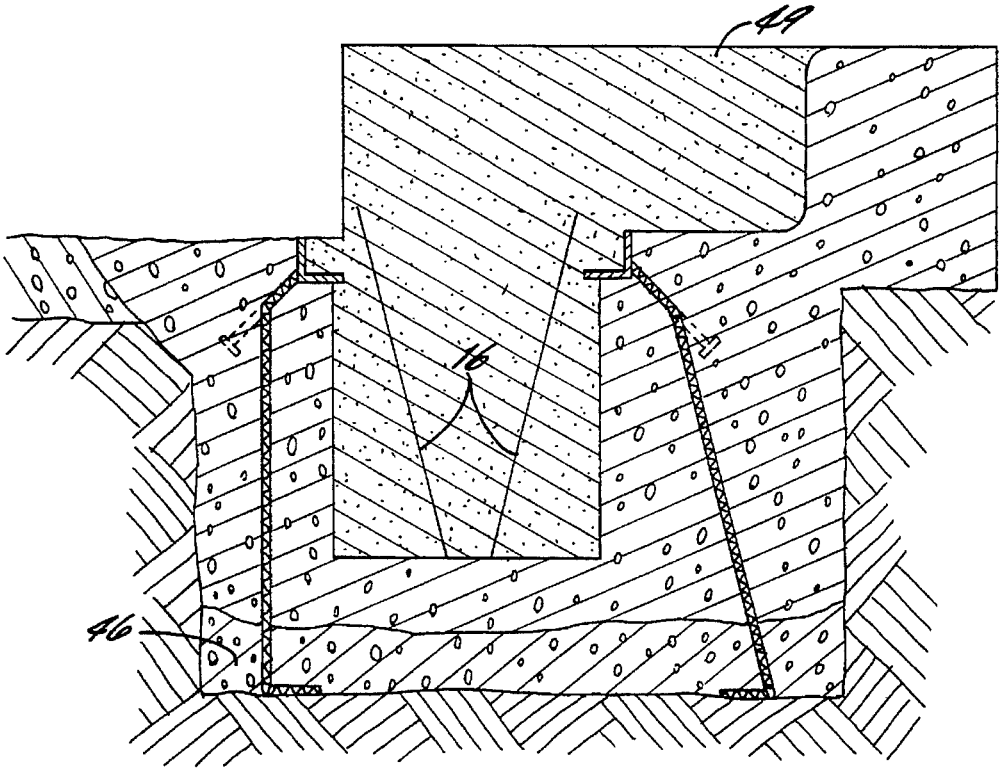
FIG. 11 is a cross-sectional view of a trench forming assembly including an elongate form body including a second body portion for defining and forming a curb structure adjacent to the trench.

In one embodiment of the present invention, the removable form also includes a second elongate form body portion 49 as illustrated in cross-section in FIG. 11. The second elongate form body portion 49 extends laterally along at least one side surface 12*c* of the main or trench-shaping portion of elongate form body 12. Preferably, the second elongate form body portion 49 also extends above the lower portion 20 of the top surface 12*a* and is integrally joined by a portion of the form material of the top surface 12*a* to the main portion of the elongate form body 12.

The second elongate form body portion 49 has a predetermined external shape adapted for forming a surface having a corresponding shape. Preferably the external shape of the second elongate form body portion 49 is adapted for shaping a curb of predetermined shape adjacent to the trench. Accordingly, a trench and an adjacent curb may be simultaneously formed from a unitary removable form so as to accurately align the curb and trench.

As illustrated in FIG. 11, the anchoring leg 42 underlying the second elongate form body portion 49 preferably extends angularly outward from the corresponding frame member 14. This outward angular extension of the underlying anchoring leg 42 provides additional support for the hydraulic forces imparted by the trench forming composition of the overlying second form body portion 49.

FIGS. 2–9 illustrate use of the trench forming assemblies of the invention. In use, the elongate form assembly is placed in a predetermined location, such as a preformed ditch as illustrated in FIG. 2. The form assembly preferably includes frame members 14, an elongate form body 12, means formed on opposed side surfaces 12*c* of the form body for engaging the frame members 14 with the removable form and first and second form removal slots 16 extending upwardly from the bottom surface 12*b* of the form body. As previously explained, the form removal slots 16 preferably extend upwardly above the frame members 14 to define, in transverse cross-section, a truncated V-shaped wedge portion 22 of the form body integrally joined to corresponding lateral portions 24 of the form body by at least a portion of the top surface 12*a*.

Figure 4:
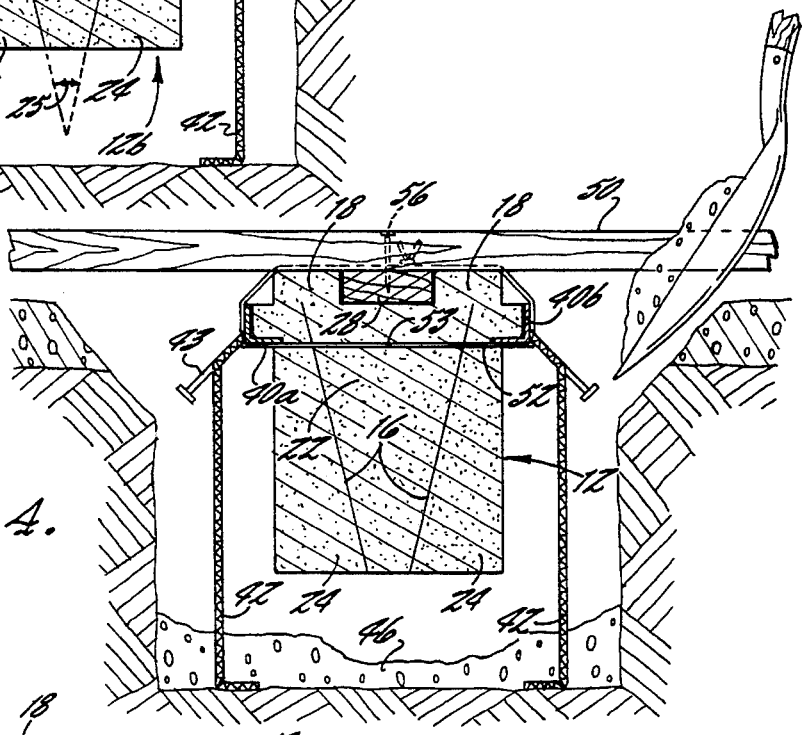
FIG. 4 is a cross-sectional view of the trench forming assembly of FIGS. 1–3 during pouring of a subslab of moldable trench forming composition about a lower portion of the legs of the frame.
Figure 5:
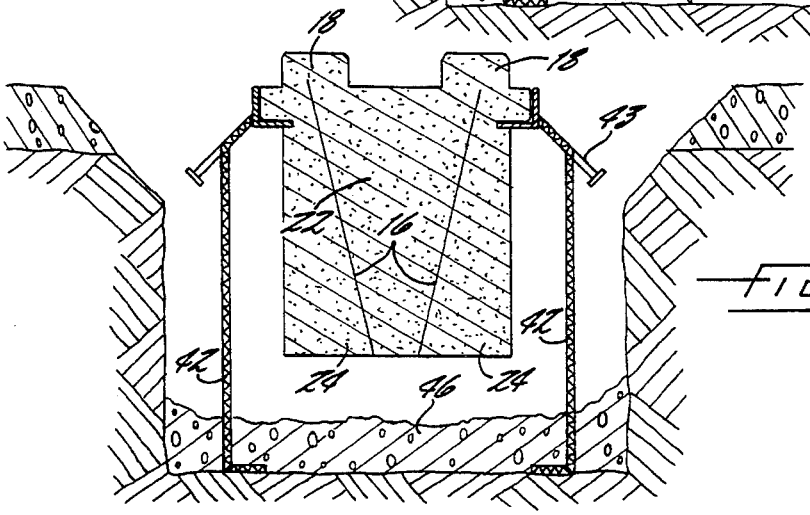
FIG. 5 is a cross-sectional view of the trench forming assembly following setting of the trench forming composition and removal of the batter boards.
Figure 6:
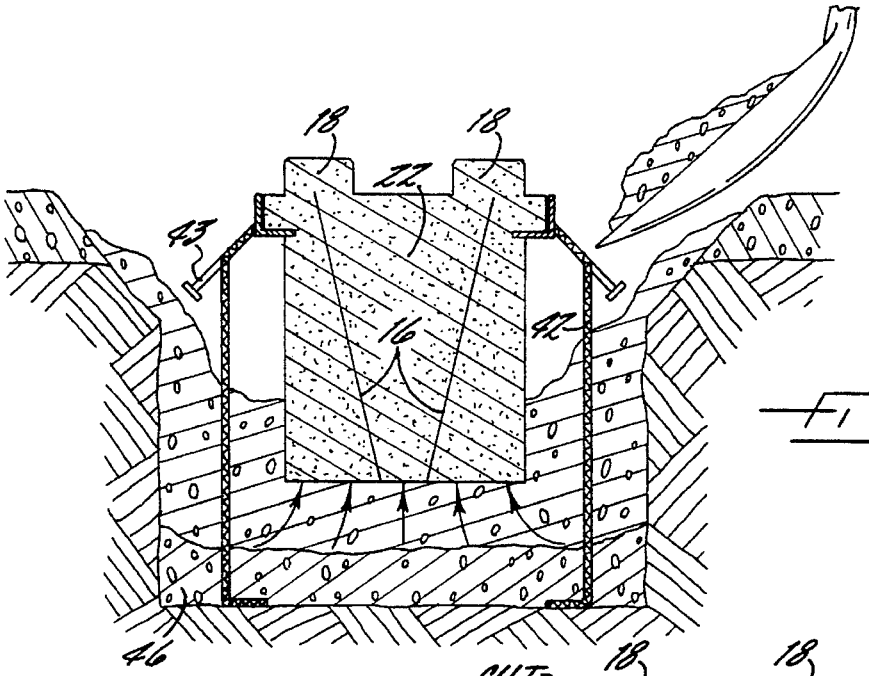
FIG. 6 is a cross-sectional view of the trench forming assembly and illustrates a moldable trench forming composition being poured about the removable form body.

The elongate form assembly is thereafter anchored in the ditch. Preferably, the form assembly is anchored by pouring a subslab 46 of hardenable trench forming composition, such as concrete, in the ditch. The subslab 46 is poured about a lower end of a plurality of legs 42 and below the bottom surface of the form body as illustrated in FIG. 4. Once the subslab 46 has hardened or set, the frame members 14, as well as the removable form engagedly retained by the frame members 14, are held in a fixed relation with the ditch.

Subsequently, additional hardenable trench forming composition is poured between the bottom and opposed side surfaces 12*c* of the removable form and the earthen walls of the ditch. In the embodiment illustrated in FIG. 6, the trench forming composition preferably fills the ditch about the form body up to the uppermost portion of the elongate horizontal leg 40*a* of the frame members 14.

Once the hardenable trench forming composition has hardened or set, the elongate form body 12 is removed. More particularly, the elongate form body 12 is removed by first removing the truncated V-shaped wedge portion 22 formed by the first and second form removal slots 16 and then removing the corresponding lateral portions 24 of the form body. As illustrated in FIG. 7, the truncated V-shaped wedge portion 22 is preferably removed by severing at least a portion of the top surface 12*a* of the form body which integrally joins the truncated V-shaped wedge portion 22 to the corresponding lateral portions 24. Following severance of those portions of the top surface 12*a*, the truncated V-shaped wedge portion 22 may be removed as illustrated in FIG. 8. Once the truncated V-shaped wedge portion 22 has been removed, the corresponding lateral portions 24 may be disengaged from the longitudinal slots 38 in the form body and removed from the trench as illustrated in FIG. 9.

Thereafter, a trench cover 48, such as a grate, may be placed upon a support portion of the coplanar horizontally elongate legs 40*a* of frame members 14. In preferred embodiments, the thickness of the trench cover 38 and the height of the vertical legs 4O*b* of the frame members 14 are approximately equal. Thus, by aligning the uppermost portion of the rails 14 with the upper surface of the trench forming composition poured about the form assembly, the upper surface of the trench cover 48 lies flush with the surrounding ground and the upper edges 51 of the trench.

During placement of the form assembly in the preformed ditch, a plurality of batter boards 50 are preferably removably attached to the top surface 12*a* of the removable form. As illustrated in FIG. 2, the batter boards 50 typically extend laterally across the top surface 12*a* of the removable form. The batter boards 50 can be affixed to the ground by means such as wooden stakes or the like (not shown), so that the form assembly is held or suspended in a fixed relation within the ditch. Thus, the form assembly may be properly aligned by appropriately positioning the batter boards 50 with respect to the ditch.

In addition, in embodiments of the removable form body 12 which include a top surface 12*a* having first and second laterally spaced ear portions 18 that are spaced to define a longitudinal central recess therebetween, an alignment member 28 is preferably placed into the central recess. The alignment member 28 is further preferably attached to the form assembly by a cord or wire 52. As discussed in the previously incorporated U.S. patent application Ser. No. 07/768,610 to Stegall, the cord or wire 52 also holds the frame members 14 in engagement with the slots 28 of the form body 12. The cord or wire 52 is preferably disposed within a slot 53 formed laterally across the form body 12. The lateral slot 53 extends downwardly from the top surface 12*a* of the form body 12 to a position below the longitudinal frame member engagement slots 38.

In this embodiment, the batter boards 50 may be attached to the alignment member 28, by various means such as by a nail 56, so that alignment of the batter boards 50 with respect to the ditch may appropriately align the form assembly. Once the subslab 46 of trench forming composition has hardened about the lower portions 20 of the legs 42 of the frame means 14 and anchored to the form assembly in the ditch, the alignment member 28 and the batter boards 50 may be removed. The alignment member 28 and the attached batter boards 50 may be retained and reused on subsequent trench installations.

The form body 12 may thereafter be removed from the trench as previously discussed. For example, in embodiments of the removable form which include a top surface 12*a* which include at least a first ear portion 18, the form body is preferably removed by severing at least a portion of the first ear portion 18 which integrally joins the truncated V-shaped wedge portion 22 with the corresponding lateral portions 24.

In preferred embodiments of the form body which include a top surface 12*a* having first and second ear portions 18, each of which are relatively narrow, i.e., have a lateral width of less than about 6 in., the removal of the truncated V-shaped wedge portion preferably includes the step of severing the portions of the first and second ear portions 18 which connect the V-shaped wedge portion 22 to the corresponding lateral portion as illustrated in FIG. 7. Severing of the ears can readily be accomplished by scraping the top of the form body with a shovel or the like, or with the scoop of a backhoe. Alternatively, a hand held automatic radial saw can be used to cut along the top of the ear or ears and into the preformed removal slot or slots.

As previously discussed, the form body 14 may also include a second elongate form body portion 49 as illustrated in FIG. 11. The form assembly illustrated in FIG. 11 is installed in a similar fashion to that previously discussed such that the form assembly is placed and anchored in the predetermined location, such as a preformed ditch, with a subslab 46 of trench forming composition. Hardenable trench forming composition is thereafter poured between the earthen walls of the ditch and the bottom and side surfaces 12*c* of the removable form body, including the second elongate form body portion 49. The form body 12, including the second elongate form body portion 49, is thereafter removed so that a trench and an adjacent structure, such as a curb, are simultaneously formed. In this fashion, a trench and an adjacent curb is efficiently formed and aligned.

During the pouring and hardening of the trench forming composition about the bottom and side surfaces 12*c* of the removable form, considerable upwardly directed hydraulic force is exerted by the trench forming composition on the exterior surfaces of the removable form 14 due to the lower density of the form body 14. In addition to facilitating removal of the V-shaped wedge portion 22 from the removable form, the diverging first and second form removal slots 16 and the limited lateral distance therebetween on the bottom surface 12*b* of the form body limit the amount of upward force applied by the trench forming composition on the V-shaped wedge portion 22. In addition, the inward lateral hydraulic forces applied by the trench forming composition to the sides the form body increase the frictional engagement between the lateral or side portions of the form body and the interior wedge portion thereof. These forces also assist in retaining the V-shaped wedge portion 22 within the form body. Thus, the V-shaped wedge portion 22 is prevented from being separated from the corresponding lateral portions 24 of the form body and forced upward by the forces applied by the trench forming composition.

The invention has been described in considerable detail with reference to preferred embodiments. However, many changes, variations, and modifications can be made without departing from the spirit and scope of the invention as described in the foregoing specification and defined in the appended claims.

That which is claimed is:

1. A removable form for forming a trench of predetermined shape comprising:

an elongate form body having a shape for shaping a trench forming composition into said predetermined shape of said trench and comprising top, bottom, and opposed side surfaces;

said top surface defining in transverse cross-section a complex shape including first and second Upwardly extending ear portions extending above at least one lower portion of said top surface located on a portion of said surface laterally between Said ear portions, said first and second ear portions extending longitudinally along said top surface for substantially the entire length thereof; and said first and second ear portions cooperating to define a recess extending longitudinally along said top surface of said elongate form body for substantially the entire length thereof, said recess being of a predetermined size adapted to receive an alignment member of predetermined cross-section.

2. The removable form according to claim 1 further comprising first and second elongate form removal slots extending from said bottom surface upwardly into said form body to define in transverse cross-section a truncated V-shaped wedge portion of said form body integrally joined to other portions of said form body by at least a portion of said top surface.

3. The removable form according to claim 2 wherein said upwardly extending first and second form removal slots diverge such that the lateral spacing therebetween increases in the upward direction from the bottom surface of the form toward the top surface thereof.

4. The removable form according to claim 3 wherein said lateral spacing between said first and second form removal slots at the bottom surface of the form body is less than about 1.5 inch.

5. The removable form according to claim 3 wherein said first and second form removal slots define an angle of between about 5° and about 45°.

6. The removable form according to claim 2 wherein said first form removal slot extends into a portion of said first ear portion, and wherein said second form removal slot extends into a portion of said second ear portion.

7. The removable form according to claim 6 wherein said first form removal slot extends at least ¼ inch into said first ear portion and said second form removal slot extends at least ¼ inch into said second ear portion.

8. A removable form according to claim 1 wherein an upper surface of said first and second ear portions is spaced at least about two inches above said lower portion of said top surface.

9. A removable form according to claim 1 further comprising a second elongate form body portion extending above said lower portion of said top surface and laterally along at least one side surface of said first elongate form body and having a predetermined external shape for forming a surface having a corresponding shape.

10. A removable form according to claim 9 wherein said second elongate form body portion is integrally joined by a portion of form material of said top surface to said elongate form body, and wherein said external shape of said second elongate form body portion defines a corresponding curb of predetermined shape adjacent to the trench.

11. An assembly for forming a trench of predetermined shape comprising:

frame members defining a support surface for supporting a trench cover;

a removable elongate form body for shaping a moldable trench forming composition poured around said form comprising a bottom surface and opposed side surfaces and defining said predetermined shape of said trench;

means formed along said opposed side surfaces of said form body for engaging said frame members with said removable form at a location spaced above the bottom surface of said form body; and first and second form removal slots in said form body extending upwardly into said form body from said bottom surface thereof substantially along the length thereof, at least one of said form removal slots extending within said form body upwardly above said frame members.

12. A trench forming assembly according to claim 11 wherein said removable elongate form body further includes a top surface extending between said opposed side surfaces and defining in transverse cross section a complex shape including at least a first upwardly extending ear portion extending above at least one lower portion of said top surface, said ear portion extending longitudinally along said top surface for substantially the entire length thereof, and wherein at least one of said form removal slots extends into a portion of said first ear portion.

13. A trench forming assembly according to claim 12 wherein said first and second form removal slots define, in transverse cross section, a truncated V-shaped wedge portion of said form body integrally joined to other portions of said form body by at least a portion of said top surface.

14. A trench forming assembly according to claim 12 wherein both said first and second form removal slots extend into a portion of said first ear portion.

15. A trench forming assembly according to claim 12 wherein said top surface additionally comprises a second upwardly extending ear portion extending above at least one lower portion of said top surface, and wherein said lower portion of said top surface is positioned between said first and second ear portions.

16. A trench forming assembly according to claim 15 wherein said second form removal slot extends into said second ear portion.

17. A trench forming assembly according to claim 15 wherein said first and second ear portions and a lower portion of said top surface positioned between said first and second ear portions cooperate to define a substantially rectangular recess extending longitudinally along said top surface of said elongate form body for substantially the entire length thereof and sized to receive an alignment member of predetermined cross section.

18. A trench forming assembly according to claim 11 wherein said form removal slot extending upwardly above said frame means extends at least about ¼ inch above said frame means.

19. A trench forming assembly according to claim 11 further comprising a second removable elongate form body portion extending laterally along at least one side surface of said first elongate form body and having a predetermined external shape for forming a surface having a corresponding shape.

20. A trench forming assembly according to claim 19 wherein said second elongate form body portion is integrally joined by a portion of form material to said first elongate form body, and wherein said external shape of said second elongate form body portion defines a corresponding curb of predetermined shape adjacent to the trench.

21. A trench forming assembly according to claim 11 wherein said means for engaging said frame means with said removable form includes first and second horizontal longitudinally extending frame member engagement slots defined in said opposed sidewalls of said form body.

22. An elongate drainage trench forming assembly according to claim 21 wherein said first and second longitudinal frame member engagement slots extend approximately ⅜ inch into said first and second sidewalls, respectively.

23. A trench forming assembly according to claim 21 wherein said frame members comprises first and second elongate frame members adapted for insertion in said first and second longitudinal alignment slots, respectively.

24. A trench forming assembly according to claim 23 wherein said first and second frame members include a plurality of legs extending downwardly therefrom for anchoring said form body in a subslab of moldable trench forming composition poured around a lower portion of said plurality of legs and below said bottom surface of said form body.

25. A trench forming assembly according to claim 23 wherein each of said first and second elongate frame members is comprised of a horizontal elongate leg adapted for insertion in a longitudinal alignment slot in said form body and an elongate vertical leg affixed, along a first edge, to said horizontal leg.

26. A trench forming assembly according to claim 23 wherein each of said first and second elongate frame members comprise an elongate horizontal leg adapted for supporting a trench cover and an elongate vertical leg extending downwardly from said elongate horizontal leg having an inwardly extending removable horizontal tab adapted for insertion in a longitudinal slot defined in a sidewall of said form body.

27. A trench forming assembly according to claim 26 wherein each of said first and second elongate frame members further comprise a raised rim portion extending longitudinally along an outer edge of each of said elongate horizontal legs for aligning said trench cover.

28. A trench forming assembly according to claim 23 wherein each Of said first and second elongate frame members comprises elongate upper and lower horizontal legs and an elongate vertical leg extending between said upper and lower horizontal legs such that said upper and lower horizontal legs extend outwardly in opposite directions from said vertical leg.

29. A removable form for forming a trench of predetermined shape comprising:

an elongate form body for shaping a moldable trench forming composition poured around said form comprising a bottom surface and opposed side surfaces and defining said predetermined shape of said trench;

said form body comprising a pair of coplanar elongate slots integrally formed in said side surfaces at a location spaced above said bottom surface for receiving a pair of frame members in a predetermined coplanar, spaced relationship above the bottom surface of said form body; and first and second form removal slots in said form body extending upwardly into said form body from said bottom surface thereof substantially along the length thereof, at least one of said form removal slots extending within said form body upwardly above said elongate slots by at least about ¼ inch.

30. A removable form according to claim 29 wherein said elongate form body further includes a top surface extending between said opposed side surfaces and defining in transverse cross section a complex shape including at least a first upwardly extending ear portion extending above at least one lower portion of said top surface, said ear portion extending longitudinally along said top surface, and wherein at least one of said first form removal slot extends into a portion of said first ear portion.

31. A removable form according to claim 30 wherein said first and second form removal slots define in transverse cross section a truncated V-shaped wedge portion of said form body integrally joined to other portions of said form body by at least a portion of said top surface.

32. A removable form according to claim 30 wherein both said first and second form removal slots extend into a portion of said first ear portion.

33. A removable form according to claim 30 wherein said top surface additionally comprises a second upwardly extending ear portion extending above at least one lower portion of said top surface and wherein said lower portion of said top surface is positioned between said first and second ear portions.

34. A removable form according to claim 33 wherein said second form removal slot extends into a portion of said second ear portion.

35. A removable form according to claim 33 wherein said first and second ear portions and said lower portion of said top surface positioned between said first and second ear portions cooperate to define a substantially rectangular recess extending longitudinally along said top surface of said elongate form body for substantially the entire length thereof and sized to receive an alignment member of predetermined cross section.

36. A removable form according to claim 29 further comprising a second elongate form body portion extending laterally along at least one side surface of said elongate form body and having a predetermined external shape for forming a surface having a corresponding shape.

37. A removable form according to claim 36 wherein said second elongate form body potion is integrally joined by a portion of form material to said elongate form body, and wherein said external shape of said second elongate form body defines a corresponding curb of predetermined shape adjacent to the trench.

38. A method for forming an elongate trench comprising the steps of:

placing an elongate form assembly in a predetermined location;

said form assembly comprising a removable elongate form body for shaping a moldable trench forming composition poured around said form comprising a top, bottom and opposed side surfaces wherein said bottom and opposed side surfaces define the predetermined shape of said trench, said form body additionally comprising first and second form removal slots extending upwardly into said form body from said bottom surface thereof substantially along the length thereof and defining in transverse cross-section a truncated V-shaped wedge portion of said form body integrally joined to corresponding lateral portions of the form body by at least a portion of said top surface;

pouring hardenable trench forming composition around said elongate form assembly to form a trench having a predefined shape; and severing at least a portion of said top surface of said form body from the top surface downwardly into the form body so that at least a portion of the top surface integrally joining said truncate V-shape wedge portion and said corresponding lateral portions of the form body are severed after the trench forming composition has been hardened to facilitate removal of said form body from said trench.

39. A method for forming an elongate trench according to claim 38 further comprising the step of anchoring said elongate form assembly in said predetermined location before said pouring step.

40. A method for forming an elongate trench assembly according to claim 39 wherein said form assembly further comprises first and second longitudinal frame member engagement slots defined in said opposed side surfaces of said form body at a location spaced above the bottom surface of said form body and frame means defining a support surface for supporting a trench cover and including first and second elongate rails adapted for insertion in said first and second longitudinal frame member engagement slots, respectively, and a plurality of legs extending downwardly from both said first and second elongated rails, and wherein the anchoring step comprises the step of pouring a subslab of said hardenable trench forming composition about a lower end of said plurality of legs and below said bottom surface of said form body.

41. A method for forming an elongate trench according to claim 38 further comprising the step of removing said elongate form body from said trench after the severing step by first removing said truncated V-shaped wedge portion formed by said first and second form removal slots and then removing said corresponding lateral portions of said form body.

42. A method for forming an elongate trench assembly according to claim 38 wherein said top surface of said elongate form assembly includes first and second upwardly extending ears and wherein said first form removal slot extends into said first ear and said second form removal slot extends into said second ear, said severing step further including the step of severing at least a portion of both said first and second ears prior to removing said truncated V-shaped wedge portion from said elongate form.

43. A method for forming an elongate trench according to claim 38 wherein said predetermined location includes a ditch, and wherein the placing step further includes the step of aligning said elongate form assembly in said ditch.

44. A method for forming an elongate trench according to claim 43 wherein said top surface of said elongate form assembly includes first and second upwardly extending ears having inside edges cooperating with a lower portion of said top surface to define therebetween a substantially rectangular central recessed portion extending longitudinally along said elongate form body for substantially the entire length thereof and sized to receive an alignment member of predetermined cross section, and wherein the aligning step includes the steps of positioning an alignment member in said central recessed portion of said form body and anchoring said alignment member in a fixed relation with said ditch.

45. A method for forming an elongate trench assembly according to claim 43 further comprising the step of providing a ditch prior to the placing step.

46. A method for forming an elongate trench according to claim 38 wherein said form assembly further comprises a second removable elongate form body extending above a lower portion of said top surface and laterally along at least one side surface of said first elongate form body and having a predetermined external shape for forming a correspondingly shaped curb adjacent to the trench, and wherein the pouring step includes the step of pouring hardenable trench forming composition around the second elongate form body.

47. A method for forming an elongate trench according to claim 46 further comprising the step of removing said elongate form body and said second elongate form body after the trench forming composition has hardened by first removing said truncated V-shaped wedge portion formed by said first and second form removal slots and then removing both said corresponding lateral portions of said form body and said second form body.

48. A form body for forming a trench of predetermined shape and adapted to be removed from a finished trench following formation of the trench as a plurality of separate longitudinal pieces, said form body comprising:

an elongate form body having a shape for shaping a trench forming composition into said predetermined shape of said trench and comprising top, bottom and opposed side surfaces, wherein the top surface defines, in transverse cross-section, a complex shape including at least a first upwardly extending ear portion extending above at least one lower portion of the top surface, and extending longitudinally along the top surface for substantially the entire length thereof; and first and second elongate form removal slots in said body, each slot extending from said bottom surface upwardly into said form body, and at least one of said form removal slots extending into a portion of the first ear portion.

49. The form body according to claim 48 wherein said first and second form removal slots define, in transverse cross-section, a truncated V-shaped wedge portion of said form body integrally joined to corresponding lateral portions of said form body by at least a portion of the top of said form body, whereby said form body is thereby separable into a plurality a plurality of pieces to facilitate removal of said form body from said trench by severing a portion of the top surface of said form body which joins the truncated V-shaped wedge portion and the corresponding lateral portions of said form body.

50. The form body according to claim 48 wherein the second form removal slot also extends into a portion of the first ear portion.

51. The form body according to claim 48 wherein said upwardly extending first and second form removal slots diverge such that the lateral spacing therebetween increases in the upward direction from the bottom surface of the form toward the top surface thereof.

52. The form body according to claim 51 wherein said lateral spacing between said first and second form removed slots at the bottom surface of the form body is less than about 1.5 inch.

53. The form body according to claim 51 wherein said first and second form removal slots define an angle of between about 5° and about 45°.

* * * * *

UNITED STATES PATENT AND TRADEMARK OFFICE
CERTIFICATE OF CORRECTION

PATENT NO. : 5,478,169

DATED : December 26, 1995

INVENTOR(S) : Lannie L. Stegall

It is certified that error appears in the above-identified patent and that said Letters Patent is hereby corrected as shown below:

On the cover page, Column 1, add: -- Assignee: ABT, Inc., Troutman, N.C. --.

On the cover page, Column 2, add: -- Attorney, Agent, or Firm - Bell, Seltzer, Park & Gibson --.

On the cover page, Column 1, References (No. 4), "8/1929 Alder" should be -- 6/1927 Jones --.

On the cover page, Column 1, References (No. 7), "Alder" should be -- Adler -- .

On the cover page, Column 1, References (No. 18), "Mayfield" should be -- Mayfield et al. --.

On the cover page, Column 2, Other Publications, add -- Trench Former System, brochure by ABT, Inc., TF 6/92; Neenah Foundry Company Catalog, 1986, pp.262-63; and two unnumbered pages (1985) --.

Column 2, line 27, "Stegell" should be -- Stegall --.

Column 2, line 27 after "1991" insert -- now U.S. Patent No. 5,281,051, issued January 25, 1994 --.

Column 3, line 65, the period (.) should be a comma (,).

Column 4, line 15, omit "and".

UNITED STATES PATENT AND TRADEMARK OFFICE
CERTIFICATE OF CORRECTION

PATENT NO. : 5,478,169

DATED : December 26, 1995

INVENTOR(S) : Lannie L. Stegall

It is certified that error appears in the above-identified patent and that said Letters Patent is hereby corrected as shown below:

Column 4, line 64, after "removal" insert -- of --.

Column 5, line 61, "from" should be -- form --.

Column 6, line 14, before "bottom" insert -- the --.

Column 6, line 19, "12a" should be -- 26 --.

Column 7, line 4, omit "07/768,610 and insert -- 08/120,214 --.

Column 7, line 6 after "MEANS" insert -- , now issued as U.S. Patent No. 5,399,047, --.

Column 7, line 31, "40h" should be -- 40b --.

Column 8, line 4, "13e" should be -- 38 --.

Column 8, line 8, "filet" should be -- fillet --.

Column 9, line 24, "4Ob" should be -- 40b --.

Column 9, line 45, after "recess" insert -- 26 --.

Column 10, line 13, after "portion" insert -- 22 --.

Column 10, line 48, after "sides" insert -- of --.

Column 11, line 3, "Upwardly" should be -- upwardly --.

Column 11, line 6, "Said" should be -- said --.

UNITED STATES PATENT AND TRADEMARK OFFICE
CERTIFICATE OF CORRECTION

PATENT NO. : 5,478,169

DATED : December 26, 1995

INVENTOR(S) : Lannie L. Stegall

It is certified that error appears in the above-identified patent and that said Letters Patent is hereby corrected as shown below:

Columns 12-15, "cross section" should be -- cross-section --. (wherever it appears).

Column 13, line 31, "Of" should be -- of --.

Column 13, line 63, "slot" should be -- slots --.

Column 14, line 28, "potion" should be -- portion --.

Column 14, line 56, "V-shape" should be -- V-shaped --.

Column 16, line 35, omit "a plurality" (duplicate).

Column 16, line 49, "removed" should be -- removal --.

Signed and Sealed this

Twenty-fourth Day of June, 1997

Bruce Lehman

*Attest:*

BRUCE LEHMAN

*Attesting Officer*

*Commissioner of Patents and Trademarks*